US008122662B2

(12) United States Patent
Farrell, Jr.

(10) Patent No.: US 8,122,662 B2
(45) Date of Patent: Feb. 28, 2012

(54) LOW-COST, ENERGY-EFFICIENT BUILDING PANEL ASSEMBLIES COMPRISED OF LOAD AND NON-LOAD BEARING SUBSTITUENT PANELS

(75) Inventor: William J. Farrell, Jr., Anniston, AL (US)

(73) Assignee: Met-Rock, LLC, Anniston, AL (US)

( * ) Notice: Subject to any disclaimer, the term of this patent is extended or adjusted under 35 U.S.C. 154(b) by 359 days.

(21) Appl. No.: 12/339,782

(22) Filed: Dec. 19, 2008

(65) Prior Publication Data

US 2009/0094927 A1 Apr. 16, 2009

Related U.S. Application Data

(63) Continuation-in-part of application No. 10/696,583, filed on Oct. 30, 2003.

(60) Provisional application No. 60/422,089, filed on Oct. 30, 2002.

(51) Int. Cl.
*E04B 5/00* (2006.01)

(52) U.S. Cl. ..... 52/371; 52/405.1; 52/676; 52/791.1

(58) Field of Classification Search ..... 52/364, 52/366, 376, 388, 660, 676, 371, 375, 426, 52/384, 385, 386, 791.1, 405.1
See application file for complete search history.

(56) References Cited

U.S. PATENT DOCUMENTS

| | | | | |
|---|---|---|---|---|
| 290,133 | A | 12/1883 | Stanley | |
| 1,597,507 | A | 8/1926 | Benedict | |
| 1,664,837 | A | 4/1928 | Joseph | |
| 1,932,276 | A | 10/1933 | Joseph | |
| 1,932,274 | A | 12/1933 | Kublanow | |
| 2,669,114 | A | 2/1954 | Mills | |
| 3,407,560 | A | 10/1968 | Baumann | |
| 4,104,842 | A | 8/1978 | Rockstead et al. | |
| 4,578,915 | A * | 4/1986 | Schneller | 52/309.12 |
| 4,611,450 | A | 9/1986 | Chen | |
| 4,660,342 | A | 4/1987 | Salisbury | |
| 5,540,023 | A | 7/1996 | Jaenson | |
| 6,272,805 | B1 | 8/2001 | Ritter et al. | |
| 6,430,824 | B1 | 8/2002 | Smith | |
| 6,718,712 | B1 * | 4/2004 | Heath | 52/309.12 |
| 6,820,387 | B2 | 11/2004 | Sacks et al. | |

FOREIGN PATENT DOCUMENTS

| | | |
|---|---|---|
| JP | 8-128154 | 5/1996 |

* cited by examiner

*Primary Examiner* — William Gilbert
(74) *Attorney, Agent, or Firm* — Cahn & Samuels, LLP

(57) ABSTRACT

This invention relates to building materials and methods. A building assembly for constructing a building includes load bearing structural panels joined and finished with a non-load bearing panels. The load bearing panels comprise a structural concrete insulating panel (SCIP) comprising a pair of wire mesh members sandwiching a middle member comprising polystyrene, wherein each of said wire mesh members defines two outwardly projecting screed ridges. The non-load bearing panels comprise a pair of fiber cement boards sandwiching a polystyrene core. The load bearing SCIP panel is placed in position and then the non-load bearing panel is positioned in a desirous location abutting the SCIP. The SCIP then receives a layer of cementitious material that is cut flat using the screed ridges. The assembled SCIP and non-load bearing composite is then finished with a final finishing layer so that the entire assembly has the same outer appearance.

11 Claims, 12 Drawing Sheets

FIG. 6
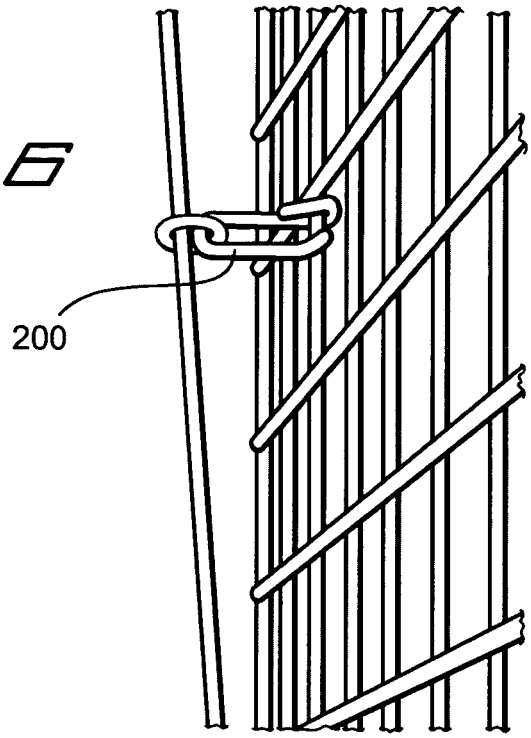
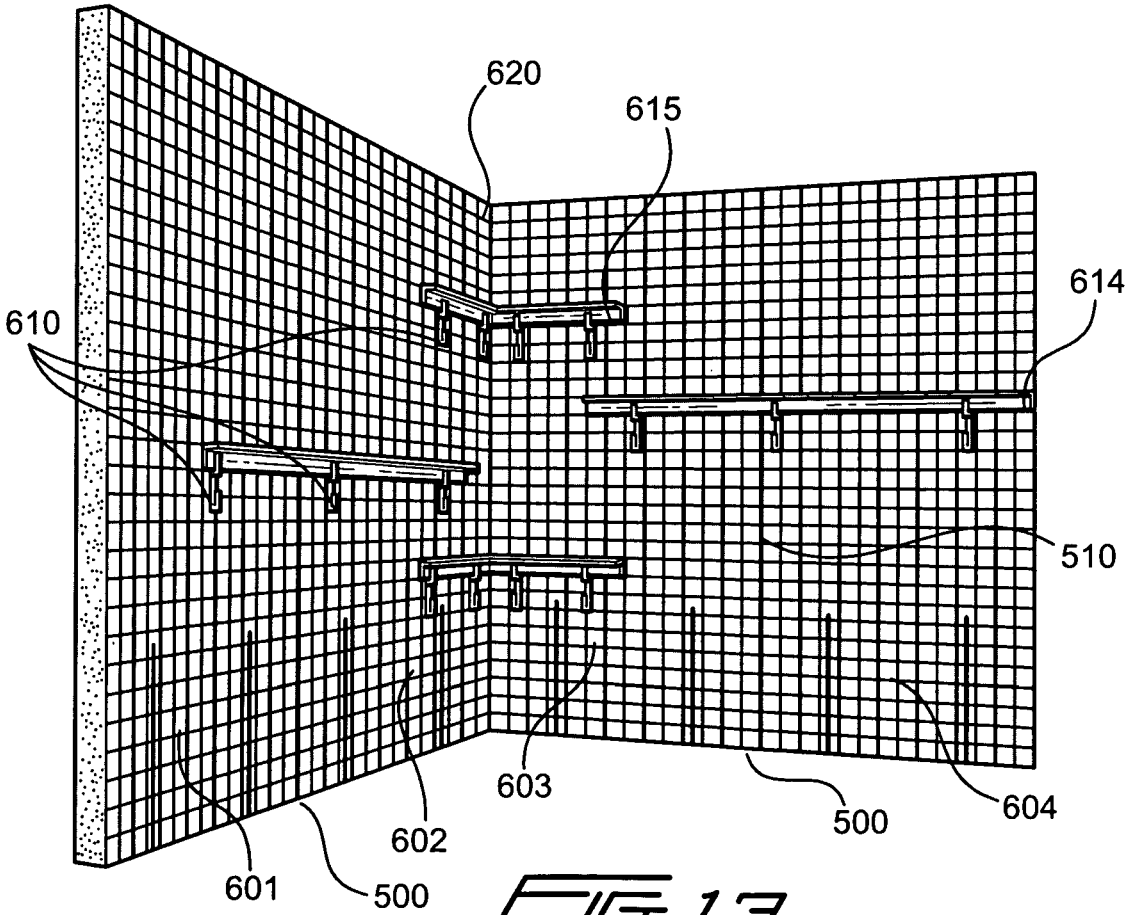
FIG. 13

LOW-COST, ENERGY-EFFICIENT BUILDING PANEL ASSEMBLIES COMPRISED OF LOAD AND NON-LOAD BEARING SUBSTITUENT PANELS

This application is a continuation-in-part of co-pending U.S. Ser. No. 10/696,583, filed Oct. 30, 2003, which is a non-provisional of U.S. Ser. No. 60/422,089 filed on Oct. 30, 2002, the contents of all of which are hereby incorporated by reference in their entirety.

I. FIELD OF THE INVENTION

This invention relates to the construction of low cost, energy efficient residential and commercial buildings. More particularly, the present invention relates to the use of exterior and supporting structural concrete insulating panels (SCIP) in conjunction with inexpensive interior and non-support walls comprised of a composite of an insulating material sandwiched between fiber cement boards.

II. BACKGROUND OF THE INVENTION

In Applicant's co-pending application U.S. Ser. No. 10/696,583, filed Oct. 30, 2003, hereby incorporated by reference in its entirety, there are disclosed novel structural concrete insulating panels (SCIP) having built-in screeds and methods of making the same that allow for non-skilled labor to assemble and finish the panels for use in the construction of dwellings, buildings, residences, and the like. These panels are currently sold commercially under the tradename "MetRockSCIP®".

A SCIP is a composite panel with an insulating core, which, in the case of MetRockSCIP®, is a core of EPS (expanded polystyrene plastic) foam. The insulating core is then enveloped with a reinforcing cage. In the case of the MetRockSCIP® the reinforcing cage is a welded wire truss with a welded wire face mesh and the two, the truss and the face mesh elements, being held together with mechanical fasteners, specifically wire C-rings. This panel assembly, of the insulating core and the reinforcing cage, is then finished with a cementitious skin, or shell, on each face. Because of the nature of the wire mesh face and the positioning of the mesh and the truss, which caused the welded-wire face mesh to be centered in the cementitious shell, the final panel is able to behave in a composite manner. In other words, because the face mesh and the cord and web ends of the truss are anchored in the two shells, the wire reinforcing cage allows the two shells to work together, fundamentally placing one shell in compression while the other goes into tension, and the whole is a composite panel, with all the parts working together to bring about the resultant structural behavior.

The behavior of the panel is somewhat analogous to the behavior of steel "I-beams" or wide-flange beams. The web connects the flanges of the beam to each other and the whole is able to act as a composite, with overall better structural behavior far greater that any or all of the parts could demonstrate acting alone. Similarly, in the MetRockSCIP® panel the shells are connected to each other by the truss, allowing all to work together. The mesh reinforces the shells and better anchors the truss in the shells. The core allows for easy fabrication of the shells and prevents the panel from becoming a solid mass of concrete, which would change it from a composite shell panel to a simple solid concrete panel, which would greatly reduce the structural performance of the panel.

Fundamental to SCIP panels is the known behavior of concrete beams and columns. It is well known and documented and is the fundamental concept behind all concrete beam and column engineering that the forces in a concrete column and beam move to the outer surface of the member, leaving the center of the member with little to no force in it. A typical design drawing of a concrete beam will show a wave passing from the top of the member to the bottom of the member and back, for the length of the member. This is to symbolize the compressive force in the top of the member and the tension force in the bottom of the member. As the wave curve passes through the center of the member we commonly speak of it passing through "zero" force or that the center is "quiet" as to forces. From this we understand that the center of the member has very little forces in it, and, hence, the steel reinforcing in a concrete beam or column is at the edge or surface of the member and little to no reinforcing is in the center of the member. The mass of the concrete in the center of the member serves principally to simply hold the outer surfaces to each other so that the loads can be transferred back and forth, as shown in a typical design wave curve.

Because beams and columns are typically created through the process of "forming and pouring" there is really no practical way of eliminating the concrete in the center of the member. Further, concrete as a material is best a compression behavior and needs the steel reinforcing bars to do a good job of resisting tension forces. It has long been known that the mass of concrete added much weight to the member and that significant portions of the reinforcing steel added to the columns and beams was there simple to overcome the added mass of the center volume of concrete. The advent of the SCIP panel, in the late 1960's was a significant advance in concrete construction.

The SCIP panel presented a way of making a reinforce concrete member, but without the disadvantage of the large mass of concrete in the center of the member but with a means of still connecting the two outer reinforced surfaces and allowing them to pass their forces back and forth to each other. The idea of placing a lightweight core in the center of a reinforcing matrix which would have sufficient connectivity between the outer surfaces to allow the forces to pass back and forth between each other, while doing so without having the large dense mass of concrete in the center of the member was indeed novel. Various means of making up the reinforcing cage and of placing the core in the center of the panel have been devised and have received patents.

Once the reinforcing cage was fabricated with the core being held in the center of the reinforcing cage, the application of the cementitious shells was rarely, if ever, addressed in any prior art. It was simply left to the user to decide on how to accomplish that aspect of the final composite panel. Various means of applying the shells have been employed: placing the cage inside a form and casting the shells by pouring concrete between the form on each face and the core; hand applying/troweling-on the shell material; spraying with any of the several plaster, air-placed concreting, shotcreting, and guniting methods; have all been used successfully.

Over time, the use of air-placed methods has become the predominant method of applying the shell material to the SCIP panel. This means that some method of pumping and spraying with air pressure is used to convey the cementitious material onto the panel. This results in a relatively fast method of getting the material onto the panel and the resulting economy of this speed is highly desirable. However, there is one very significant drawback to this method—the finished surface of the panel. When spraying the material onto the panel, the material ends up being quite rough and can have significant highs and lows to the surface. This results in the need of skilled craftsmen to smooth out the surface after the spray equipment has applied it. It is well known that the plastering trade is a declining trade in the US, having been nearly totally replaced by the use of gypsum wallboard. Because of this there are fewer and fewer skilled craftsmen who can effectively finish a sprayed wall. It may well be that this single fact is the reason that there are to date no successful SCIP panel enterprises in the US while there are many, many SCIP plants around the world. Every SCIP panel plant ever opened in the US has failed, without exception. Conversely, there are SCIP panel buildings being built daily in Mexico and around the world, where plastering skills are the norm.

It is specifically to this issue that the MetRockSCIP® panel addresses itself. As disclosed in Applicant's co-pending application U.S. Ser. No. 10/696,583, filed Oct. 30, 2003, the face mesh of the MetRockSCIP® panel includes deformations in the shape of V-shaped ridges, or "screeds," that allow an unskilled worker to quickly and accurately flatten the sprayed surface of the shell. By simply drawing a flat edged tool, known in the trade as a "rod" or "knife" along the built-in "screeds" created by the deformations in the MetRockSCIP® face mesh, the worker can quickly true up the surface and achieve results approaching the work of a skilled craftsman.

The MetRockSCIP® is a code conforming Structural Concrete Insulated Panel System that has been designed for structural walls, floors and roofs. MetRockSCIP® is a seamless, monolithic structure and meets the long term needs for affordability (as low as $10 per sq. ft), sustainability (fire, hurricane, tornado, earthquake, termite resistant), extremely energy efficient (R-40 Performance), and green (all recycled components). The MetRockSCIP® has been designed in the U.S. specifically for the U.S. Residential and Commercial markets. Non-skilled labor is all that is required for the assembly, erection and to mix, pump, spray and finish the plaster cement skins onto the panel.

The MetRockSCIP® qualifies as a green building system because all of the components of the MetRockSCIP® are recycled products. The 3/16" diameter wire trusses (show the photo of the stack of truss wires) are made of recycled steel. The 1"×1"×14 gauge wire mesh members, which feature the novel screed ridges that are made into the mesh, are made of recycled steel. The wire "C" rings, which attach the mesh to the trusses, are made of recycled steel. The foam insulation, which can be from 2" up to 12" thick, are made of recycled EPS beads. Also, the cement plaster of the commercial embodiment contains up to 30% fly ash, which is a by product of coal.

MetRockSCIP® Technology is presently available for license. Included in the license package is the Portable Assembly Jig Press which allows for panels to be assembled right on the job site if desired, Portable press brake, Blastcrete Mixer/Pump with hose package, air compressor, all assembly and erection tools, and complete training and certification. Packages vary from $60,000 up to $100,000 for protected territories, and there are currently no license or franchise fees. The license cost is directly related to the equipment that chosen for a desired license package, and the required territory. The MetRockSCIP® conforms to all local building codes.

MetRockSCIP® assembly, erection, and the cement plaster application is quick, easy and does not require skilled labor. Two unskilled laborers can assemble a Metrock Panel in five minutes using the portable jig press. Once assembled dowels are drilled and grouted to anchor the panels to the foundation. The panels are then assembled and the cover mesh is attached to cover the seams between the panels. Simple tools are used to hold the panels straight and square. Utilities are then installed prior to spraying. Once the panels have been erected, 1" of plaster cement is then spray applied to each side of the panel to make the panel structural. Approximately 6-8 square feet of panel can be covered with 1" of cement plaster per minute. The novel screed ridges, which are made into the wire mesh serve as visual depth screeds for the nozzleman while spraying the cement plaster, then serve as a mechanical screed for the worker to cut the cement plaster flat and straight without the need for skilled labor. A final 3/16 inch finish coat is then spray or trowel applied for the desired finish.

In sum, the MetRockSCIP® is the most versatile, affordable, sustainable, energy efficient, green composite building envelope ever introduced in the U.S. MetRockSCIP® lowers insurance rates and utility bills by over 60%, plus there is ZERO maintenance. Additional details and video demonstrations are available for viewing at www.MetRockSCIP.com.

While the cost of assembling an entire structure using the MetRockSCIP®methods and materials is considerably cheaper and quicker than building the structure using conventional means and conventional materials, the resultant structure includes interior and non-load bearing walls that possess the structural and impenetrable features of the MetRockSCIP® in areas where such strength and protection is unnecessary or superfluous.

However, if conventional interior building materials for non-load bearing walls are used, many of the problems in the art the MetRockSCIP® was intended to overcome are again encountered, e.g., need for source of lumber, etc.; need for skilled labor and tradesman; and/or resultant time consumption due to required framing, insulating, finishing, etc.

Accordingly, there exists a need in the art for allowing interior and non-load bearing walls in a SCIP structure to be used that does not result in the drawbacks presented by conventional building materials and techniques. Moreover, the foregoing underscores the need in the art for an integrated building system which allows for building areas, such as exterior walls, roofs, etc, and other load bearing interior walls to be constructed of SCIP panels providing the strength and imperviousness desired for the building, while allowing interior and non-load bearing walls to be constructed on non-structural materials that may be finished with a matching coat or otherwise be compatible when assembled in the framework of the SCIP structure.

III. SUMMARY OF THE INVENTION

The present invention provides low-cost, energy-efficient structures that may be assembled without the need for skilled labor. The present invention is based, in part, on the concept that an impenetrable outer structure lessens the need for interior and non-load bearing walls to comprise the same impenetrable materials. The present invention seeks to allow non-load bearing and interior walls to be constructed from unconventional building materials in a manner compatible with SCIP panels to avoid the need for lumber, framing, insulating, etc. encountered with conventional building techniques and materials.

One object of the invention is to provide a SCIP building panel ready for attachment and finishing with a non-structural panel.

According to this object of the invention, one aspect of the invention is to provide an exterior or load bearing SCIP construction panel(s) for the basic framework of the structure. The SCIPs are preferably MetRockSCIPs® comprising a pair of wire mesh outer members and a middle member, wherein said wire mesh members are configured to include a plurality of outwardly extending V-shaped impressions which will serve as a visual and mechanical built-in screed. The wire mesh members may be secured to the middle member, or alternatively to each other, such that a gap for receiving rebar or other support materials is left for ease of attachment to a foundation prior to finishing. An advantageous feature according to this aspect of the invention is that the wire mesh members may be welded or clipped with hog rings to the trusses to secure the middle member.

According to an advantageous aspect of the invention, the middle member comprises a sandwich of wire trusses and polystyrene materials. In accordance with this object of the invention, the wire trusses and polystyrene materials are compressed by compression means, such as an on-site or portable jig, and secured in the compressed state by clamping means until after the wire mesh members are attached. After attachment the clamping means is removed allowing the middle member to expand and exert a force on the wire mesh members. The panels are then finished by the spraying of cementitious outer shells which are cut flat by unskilled labor using the screed ridges. The panels may then receive a final finishing layer for aesthetic purposes. A particularly advantageous aspect of this feature of the invention is that it allows for the panels to be constructed on-site.

In accordance with at least some embodiments of the invention, it is intended that the interior and non-load bearing walls and other components (hereinafter called "non-structural" walls, panels, etc.) be constructed of non-conventional materials (meaning not lumber, drywall, etc.) that are compatible with the SCIP panels (meaning can be finished with the same aesthetic finishing layers and preferably, may be assembled or sized on-site). A presently preferred non-structural panel comprises a foam core sandwich panel using James Hardie backer board (Hardie Board) or the like glued or otherwise secured to an expanded polystyrene core or like insulating material.

Although understood in the art, for clarity, Hardie Board is a fiber cement board that is typically made ⅝" or ¼" thick. According to a preferred embodiment, the non-structural walls comprise ¼" thick Hardie Board glued to a polystyrene foam core that is finished the same (e.g., material, color, pattern, etc) as interior SCIPs. The polystyrene foam core provides excellent sound dampening properties and may also compliment the energy efficiency of the SCIPs. In an alternative embodiment, instead of Hardie backer and expanded polystyrene foam, for interior walls where the foam insulation would serve only a purpose of deafening sound transmission, steel studs are used as the core between the two sheets of Hardie backer. This could be economically feasible and this would also maintain sustainability. Typically in any case, the thickness of the non-structural panel would be 3.75 to about 4 inches. As will be appreciated by one of ordinary skill in the art armed with the present specification, the use of these non-structural panels as described and claimed herein in the construction of a building will greatly reduce the cost of the building. Likewise, the non-structural panels still allow for non-skilled labor to quickly assemble and finish the panels on-site by cutting the materials to size and assembling on site or otherwise. Accordingly, suitable variations of the materials of construction of the non-structural panels should be understood to be within the scope of the invention as well as achieving the proper size and/or thickness of materials for the intended use.

Another object of the invention is to provide methods of making the aforementioned SCIP construction panels and non-structural panels and methods for finishing the aforementioned panels. Another object of the invention is to provide novel methods of installing the aforementioned SCIP construction panels and non-structural panels and joining the panels to each other or other construction components.

The invention as described and claimed herein should become evident to a person of ordinary skill in the art given the following enabling description and drawings. The aspects and features of the invention believed to be novel and other elements characteristic of the invention are set forth with particularity in the appended claims. The drawings are for illustration purposes only and are not drawn to scale unless otherwise indicated. The drawings are not intended to limit the scope of the invention. The following enabling disclosure is directed to one of ordinary skill in the art and presupposes that those aspects of the invention within the ability of the ordinarily skilled artisan are understood and appreciated.

IV. BRIEF DESCRIPTION OF THE DRAWINGS

The present invention is described with reference to the accompanying drawings. In the drawings, like reference numbers indicate identical or functionally similar elements.

FIG. 6 is a picture of a clipped-on-screed according to an alternative embodiment of the invention.

FIG. 13 is a photograph of panel members joined in a corner assembly according to the invention.

While the invention will be described and disclosed in connection with certain preferred embodiments and procedures, it is not intended to limit the invention to those specific embodiments and procedures. Rather it is intended to cover all such alternative embodiments and modifications as fall within the spirit and scope of the invention.

V. DETAILED DESCRIPTION OF THE DRAWINGS

Generally, the present invention relates to low-cost, energy-efficient buildings comprising structural and non-structural panel members that may be assembled and finished by unskilled labor.

The present invention also relates to novel methods, techniques and equipment for assembling, erecting and joining novel prefabricated structural and non-structural panels for various uses in the construction industry. While the present invention is described in connection with structural construction panels having a built-in screed or a clipped-on screed, it will be readily appreciated by one of ordinary skill in the art that the teachings of the present invention can be applied to a variety of construction needs in a variety of fields.

Likewise, while the present invention will be described in connection with non-structural panels comprising a foam core sandwiched between fiber cement board, one of ordinary skill in the art will understand that the precise materials are not necessary to achieve the intent of the present invention. In addition, while the present invention will be described in connection with erecting and joining prefabricated structural and non-structural panels constructed according to the teachings herein, one of ordinary skill in the art will appreciate that the novel tools and methods described herein can be applied to a variety of construction needs in a variety of fields. For example, the structural panels of the present invention could be used in form and pour applications, such as setting up steel forms for a basement wall then dropping the panels inside the steel form and then interior and non-load bearing walls may be attached thereto. The composite assembly may then be finished with appropriate materials for uniformity in appearance.

Figure 1:
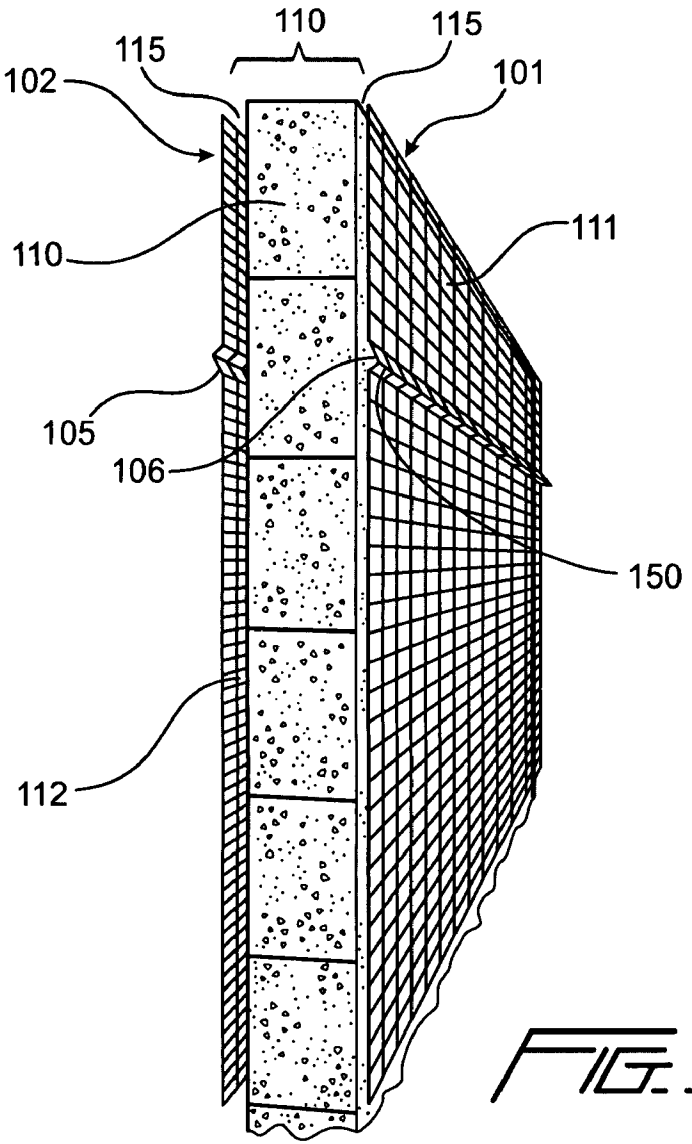
FIG. 1 is a picture of a basic SCIP panel member according to one embodiment of the invention.

A preferred embodiment of the invention uses a novel SCIP-type construction panel for building load bearing and exterior walls of a building. In its simplest form, as depicted in FIG. 1, SCIP construction panel 10 according to the invention comprises first and second wire mesh members 101, 102 and a middle member 110 disposed therebetween. The wire mesh members 101, 102 and the middle member 110 define a small gap 115 between the front 111 and back face 112 of middle member 110 and the wire mesh members 101, 102. The coupling of the wire mesh members 101, 102 to the middle member 110 is described below, as is the significance of small gap 115.

Figure 2:
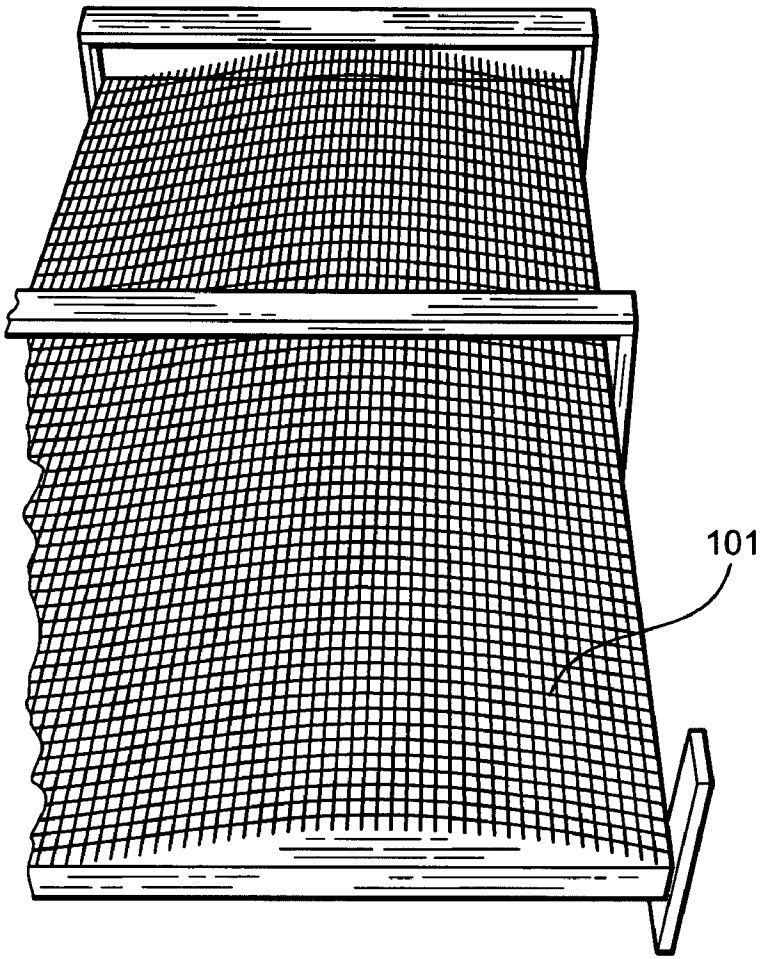
FIG. 2 is a picture of a piece of wire mesh for use in accordance with the SCIP in some embodiments of the present invention.

According to the invention, wire mesh members 101, 102 can be of any suitable wire mesh or like material. Typically, wire mesh is manufactured as a grid of vertical and horizontal welded wire strands. FIG. 2 depicts a presently preferred wire mesh material 101 for use in the present invention. As depicted in FIG. 2, wire mesh comprises a 4 foot by 8 foot piece of 1"×1" wire mesh. Preferably, the wire mesh comprises 14-gauge galvanized wire mesh. More preferably, the wire mesh comprises a 14-gauge galvanized 1"×1" wire mesh with a welded 9-gauge wire as the lead wire to each screed as described in more detail below. Alternatively, the wire mesh comprises 9 gauge galvanized wire.

Figure 3:
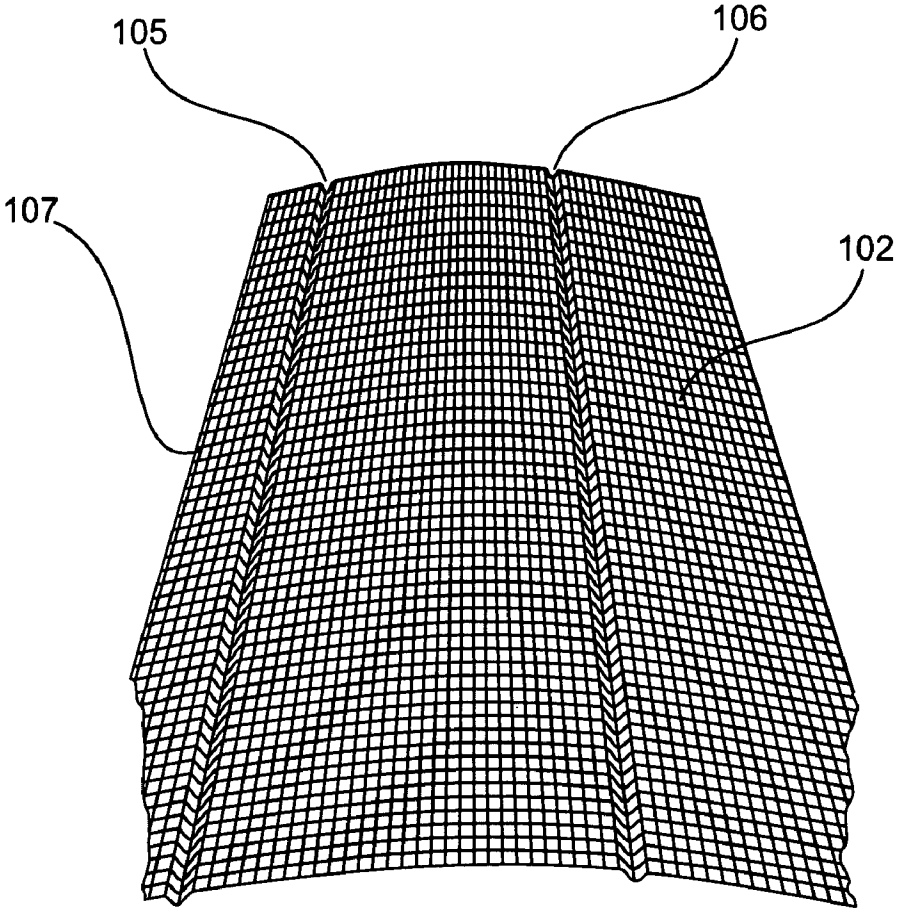
FIG. 3 is a picture of a modified piece of wire mesh for use in accordance with some embodiments of the present invention.

FIG. 3 depicts a presently preferred embodiment, which is licensed and sold commercially as the "MetRockSCIP®," that includes wire mesh 102 provided with two parallel V-shaped impressions 105, 106 along its length. Preferably, the impressions on a 48-inch wide piece of wire mesh will be spaced 30 inches apart from center, or 9 inches away from the leading edge of the panel. More preferably, the wire mesh will have two strands of 9 gauge wire (not shown) as the leading (apex) wires where the impressions are to be made. Also preferably, at least the leading wire, whether 9 gauge or not, will be coated with zinc to prevent rusting.

According to this embodiment, a 48-inch wide piece of wire mesh 102 is supplied with two ½ inch V-shaped impressions 105, 106 about 30 inches apart on center. Notably, after receiving the impressions, the wire mesh is reduced in width to approximately 47.25 inches.

Neither the distance between the impressions nor the number of impressions is critical to the invention and all such variations should be deemed to be within the scope of the invention. However, it is preferred in this embodiment to provide two impressions at no more than 40 inches apart.

Figure 7:
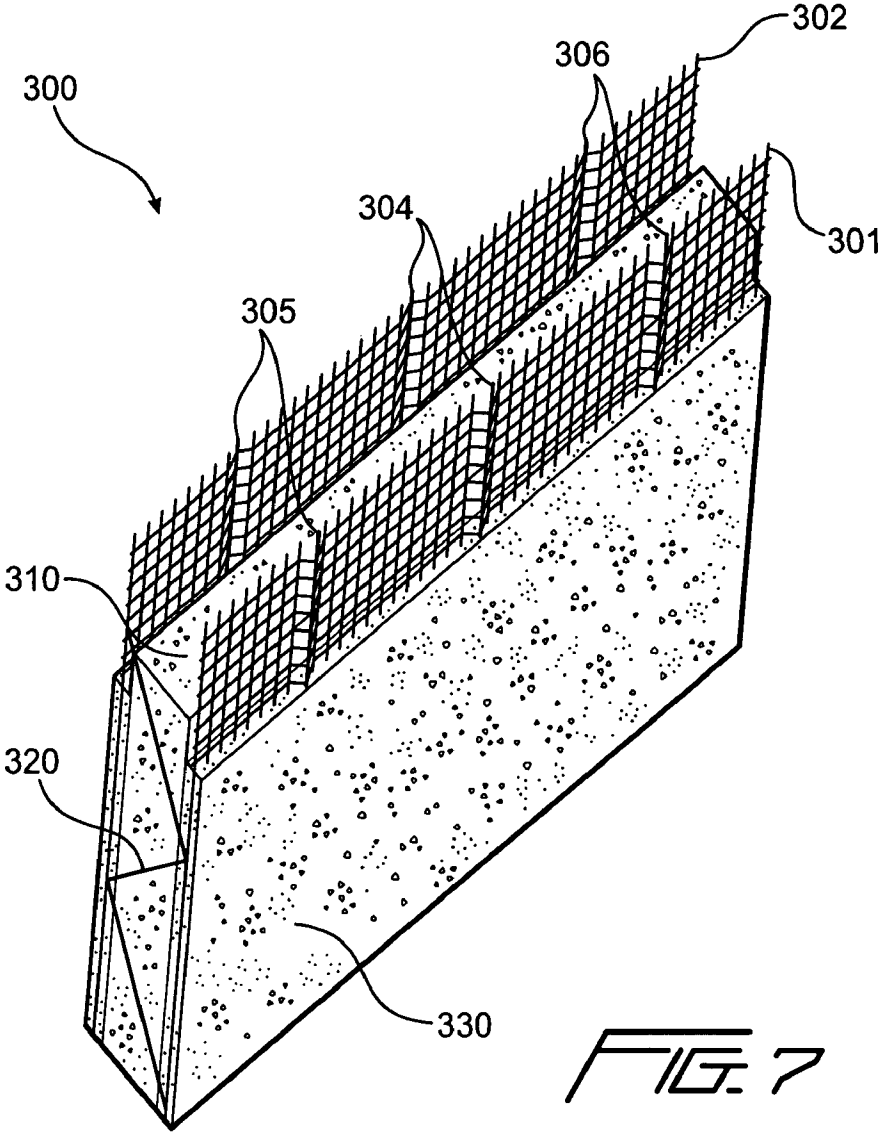
FIG. 7 is an isometric view of a preferred embodiment of a finished SCIP panel member according to the invention.

In an alternative preferred embodiment of the invention depicted in FIG. 7, the SCIP construction panel 300 includes three impressions in 48-inch mesh members 301, 302. A first impression, or middle impression 304, is centered at approximately 24 inches, and two other impressions, or left and right impressions 305, 306, are positioned approximately 8 inches from their respective edges of the panel. One advantageous feature of this configuration, which will be elaborated on herein, is that once two or more panels are joined end to end, there will be an impression approximately every 16 inches. According to this embodiment, it is preferable that at least the leading wires 304, 305, 306, if not the whole mesh, comprises 9-gauge galvanized wire. Alternatively, in a presently preferred embodiment, the wire mesh members 301, 302 comprise 1"×1" 14-gauge mill galvanized welded wire mesh with 9-gauge galvanized lead wires 304, 305, 306. One of ordinary skill in the art will appreciate that the materials of construction may be varied to take advantage of certain properties or to fit an intended use.

Additionally, as will be appreciated, the exact configuration and depth of the impressions is not critical and can be varied according the skill of one in the art to suit the intended purpose of the panel and the depth of finishing materials to be applied. Presently preferred depths for the impressions are about one half of the depth of the finishing material that is to be applied to the wire mesh or panel.

Turning back to FIG. 1, once the impressions 105, 106 are suitably made wire mesh members 101, 102 are ready for mounting to middle member 110. Middle member 110 may comprise any suitable material for the intended use of the panel 10. In a presently preferred embodiment, middle member 110 comprises a sandwich composite of wire trusses and polystyrene foam material. In a particularly preferred embodiment, middle member 110 comprises a sandwich of nine wire trusses and eight pieces of polystyrene. The middle member composite will be compressed prior to being secured between the wire mesh members, although any suitable means for compressing the composite may be utilized, the present inventors have devised a novel methods and tools for compressing the composite.

Figure 20:
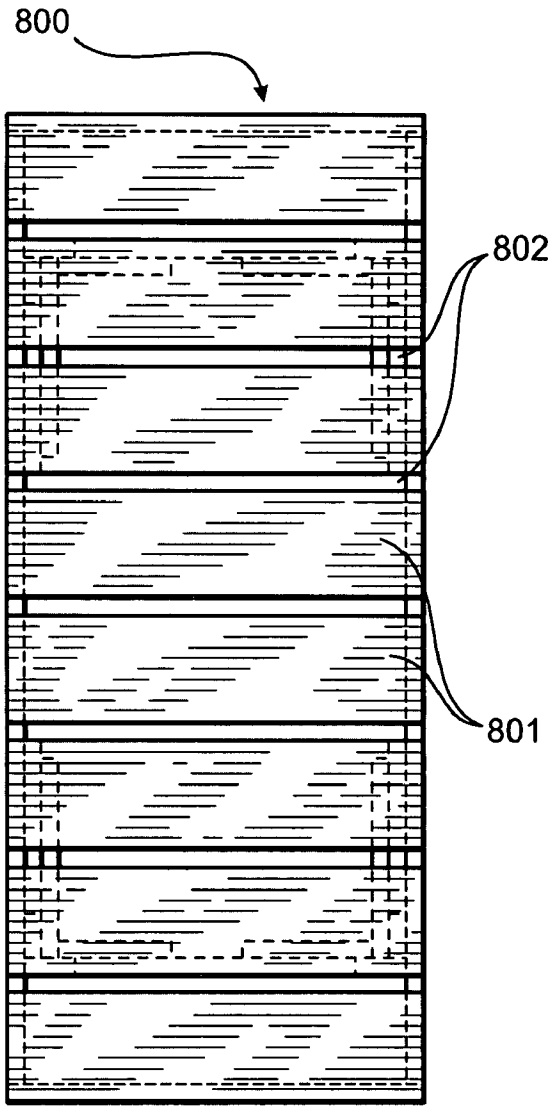
FIG. 20 is a top view of the jig table of FIG. 19.
Figure 19:
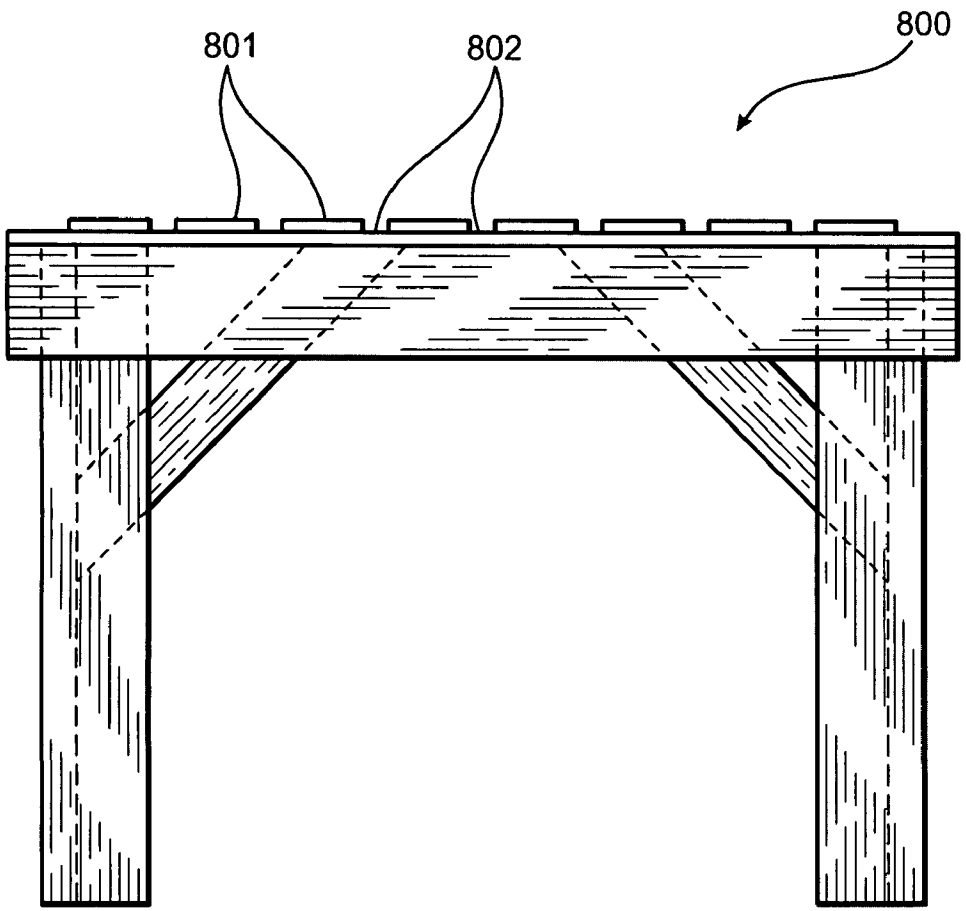
FIG. 19 is a front view of a jig table according to the invention.

As depicted in FIGS. 19 and 20, a jig table 800 is provided with eight (8) risers 801. Jig table 800 also includes nine (9) slots 802 disposed between (or on each side of) the risers to provide a gap between the risers 801. According to a presently preferred embodiment, the slots offer a 1" gap between the risers 801. The composite is positioned such that the wire trusses are dropped into each slot 802 and the polystyrene foam is positioned on top of each riser 801. Once the composite is in place, a jig press is positioned over the table and appropriately secured before the assembly process. The jig press is then manipulated to compress the composite up to 2.5 inches. According to a presently preferred embodiment, the risers are ½" high to ensure that gap 115 between the wire mesh members 101, 102, and 301, 302 and the middle member 110 and 310 is approximately ½ inch. However, as will be appreciated in view of the teachings herein, if an increased thickness of cementitious material, such as shotcrete or plaster, is desired on the sides of the panel the height of the risers 801 can be increased to the preferred size of gap 115. Changing the height of risers 801 will change the distance from the outer faces of the foam of the composite middle member 110 and 310 to the inside edge of the back face of the wire mesh members 101, 102, and 301, 302. However, the V-shaped notches will ensure that although the wire mesh members are no longer disposed in the middle of the finishing material, they remain ½" from the outer edge of the finished panel.

The compressed composite is held in the compressed state by clamps or other means of securing the composite from expansion. Once secured in the compressed state, the composite is ready for mounting of the wire mesh members 101, 102 and 301, 302. In preferred embodiment, the jig containing the composite is rotated from the horizontal to the vertical position to ease the securing of the wire mesh members 101, 102, or alternatively, and more preferably, the jig can be rotated 180 degrees completely to the horizontal.

Figure 4:
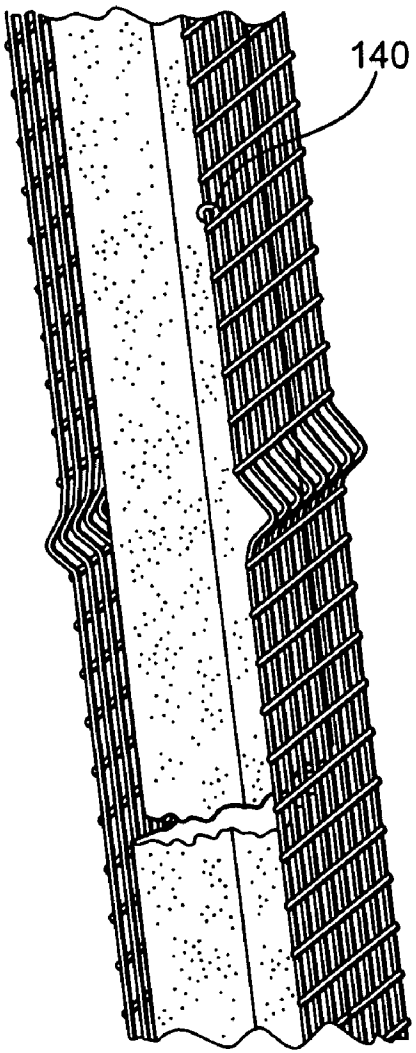
FIG. 4 is a picture of a side view of a SCIP panel member according to one embodiment of the invention.

The wire mesh members 101, 102 may be secured by any suitable means. According to one embodiment of the invention depicted in FIG. 4, the wire mesh members are secured to sandwich middle member 110 by the use of hog rings attached to wire trusses on the panel ends. This means of securing the wire mesh members around the middle member is particularly preferred for panels using 1"×1" wire mesh.

Figure 5:
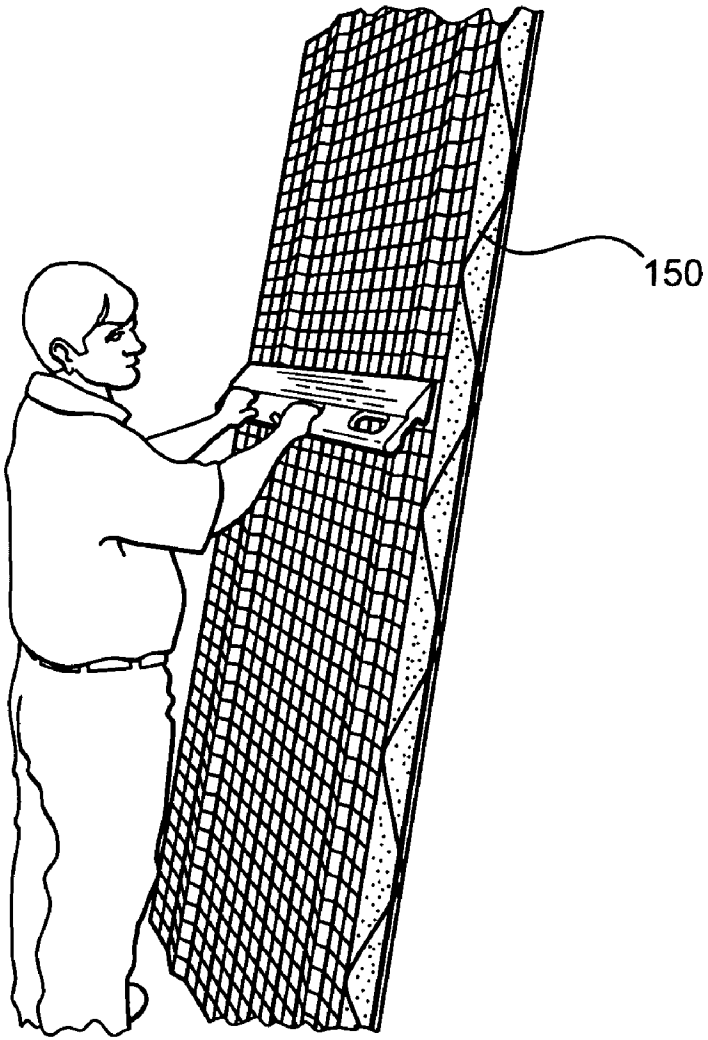
FIG. 5 is a picture of a SCIP panel member and a screed blade for use according to one aspect of the invention.

In an alternative embodiment of the invention depicted in FIG. 5, the wire mesh members are welded to the trusses. This means of securing the wire mesh members and the middle member is particularly preferred for panels using 2"×2" mesh.

As will be appreciated by one of ordinary skill in the art, numerous methods of securing the wire mesh are possible. All suitable methods should be view as within the scope of the invention, as well as combinations of such methods. In a presently preferred embodiment, the truss comprises a zig-zag wire with an apex every 16 inches. The apexes are welded to a straight stay wire on both the top and bottom of the zig-zag wire. These truss wires are placed on the jig table and the foam placed between each truss, the trusses and the foam are compressed with the jig and secured in the compressed condition with clamps or other suitable means. Once compressed and secured, the wire mesh members are attached using hog rings to the stay wire (which is welded to the zig-zag wire) on the top, and then once the jig is rotated to 90 or 180 degrees, to the bottom stay wire.

After the wire mesh members 101, 102 are secured around the middle member 110, the composite is allowed to decompress. In other words, the clamp or means for holding the composite in the compressed state is removed. Quite unexpectedly, the present inventors have discovered that after decompression, a 48-inch panel which was reduced by the V-shaped compressions to 47.25 inches, expands back to the desired 48-inch width. In addition, advantageously, the panel remains tightly in tension.

After decompression, the SCIP panel composite 10 is ready for use. SCIP panels may be assembled or attached to make an exterior or load bearing wall, or any other suitable structure, for a building or the like. For example, with buildings, the rebar extending from a concrete foundation or slab slides between the wire mesh and the middle member. The SCIP panel may then be wire tied. Other SCIP panels may likewise be placed on adjacent portions of the foundation and then connected to the previous SCIP panels. SCIP panels may be connected by any suitable means. According to one embodiment, wire mesh strips are used to cover the seems between panels by attaching the mesh with hog rings or any other suitable connector or connection means.

Once the load bearing wall(s) is erected, the panels are ready for depositing the outer cementitious layers. Any suitable cementitious material may be used in finishing the SCIPs, and will be dictated by the use and configuration of the panels. As will be appreciated in accordance with this embodiment, SCIPs being used as walls will then be sprayed with shotcrete or plaster. According to this embodiment, one inch of shotcrete or plaster is applied to the panel, and more preferably, to each side of the panel.

In view of the fact that there is a ½ inch gap 115, see FIG. 1, between each wire mesh members 101, 102 and the middle member 110, one inch of cementitious material should result in the wire mesh being embedded about half way therein. In addition, given that the wire mesh was provided with two ½ inch deep V-shaped impressions 105, 106, the apex 150 of the impressions serves as a visual screed for the application of the cementitious materials and then as a mechanical screed (allowing a 48-inch blade to be slid up and down the apexes of the impressions) to ensure the wall is cut flat and ready to be aesthetically finished with, for example, a stucco look or finishing layer.

Notably, as will be appreciated by one of ordinary skill in the art, the SCIPs can be erected with the impressions running horizontally (see FIG. 1) or vertically (see FIG. 5). In either case, the SCIPs can be cut with a screed blade running along the apexes of the V-shaped impressions. As discussed herein, these built in screed ridges allow for the panels to be cut flat using unskilled labor.

In an alternative embodiment, rather than provide impressions in the wire mesh, a screed member 200 is physically or mechanically clipped onto wire mesh members by any suitable means, such as that depicted in FIG. 6. The use of clipped-on-screed member is preferred for use with two in by two inch wire mesh. According to this embodiment, any suitable material may be used as middle member as previously described herein. In a preferred embodiment, when using two by two inch mesh, the wire mesh members are welded to middle member, more preferably, welded to wire trusses of middle member.

Clipped-on-screed member 200 may be constructed of any suitable material. In one embodiment, clipped-on-screed member comprises rigid wire, similar to that of the wire mesh members. Also, clipped-on-screed member can be configured to provide for any desired depth of finishing material, and can be attached to wire mesh members by any suitable means, such as wire tied or clipped. For large panels, it is preferred that multiple screed members be attached to the wall rather than attempting to use one long screed member to traverse the length of the panel.

Once the clipped-on-screed member or members are positioned in its desired position, the panel may be finished as previously described herein.

In operation, a preferred method of making a MetRock-SCIP® panel according to a presently preferred embodiment of the invention comprises taking a stacking of 9-gauge wire truss, or more preferably, a 3/16" diameter wire truss, with a dimension of 5 inches wide by 8 feet long into a holding press. An approximately 4 inch thick by 6 inch wide by 8 feet long piece of polystyrene is placed parallel and alongside the wire truss, then another truss, then another piece of polystyrene, until the panel has reached a desired width for the building panel. In this embodiment, 9 pieces of wire truss and 8 pieces of polystyrene foam are used. Once all these materials have been stacked like a sandwich into the panel press, the press will compress this composite by up to 2.5 inches and hold it in a compressed state until the wire mesh members can be attached to each side of the panel using ½ inch hog rings. The preferred wire mesh members in this embodiment are 48-inch pieces of 1"×1" 14-gauge wire mesh with 9-gauge welded lead wires. The wire mesh members are physically bent to define two ½ inch V-shaped depressions (with the 9-gauge lead wires at their apex) along their length thereby diminishing the width of the members to approximately 47.25 inches.

After securing the hog rings, the panel is taken out from under the compression of the press and allowed to expand. Although not wishing to be bound by theory, it is believed that the expansion of the polystyrene causes the width of the panel of this embodiment to recover from the approximately 47.25 inch width of the wire mesh back, at least approximately, to the desired 48-inch width which is needed for the building under construction. In addition, although not wishing to be bound by theory, it is believed that the tension of the panel resulting from the impression screeds being formed on the wire mesh causes the panel to remain unexpectedly secure and to not lose its shape or dimension, even though the wire mesh is secured to the truss by only about 16 hog rings to 72 hog rings, in other words, without welding.

FIGS. 7-18 depict various aspects of a presently preferred commercial embodiment of the invention known as the MetRockSCIP® panel. As previously mentioned, and as depicted in FIG. 7, the construction panel 300 includes first and second wire mesh members 301 and 302 disposed on opposite sides a middle member 310. Trusses 320 are used on each end of the panel to ensure the sandwich composite of the wire mesh members 301, 302 and middle member 310 are secured in their proper orientation. FIG. 7 also shows a 1 3/16-inch layer of concrete 330 as a finishing material applied to both sides of the panel and smoothed using the three built in screed notches 304, 305, and 306.

Although any suitable materials and any suitable configurations are contemplated by the present invention, in a presently preferred embodiment, the wire mesh members comprise a 4 foot (48 inches) by 8 foot sheet of 1 inch by 1 inch 14-gauge wire mesh. Alternatively, and as depicted in some of the Figures, the material may be a 12-inch wide 14 gauge 1"×1" galvanized wire mesh. Preferably, the wire mesh members 301, 302 will have ½-inch pressed-in screeds 304, 305, 306 with welded 9 gauge galvanized leading wire. A central screed 304 is disposed on center and a left and right screed 305, 306 are disposed 16 inches of center in their respective directions. This configuration provides for screeds every 16 inches once two or more panels are joined end to end.

Figure 9B:
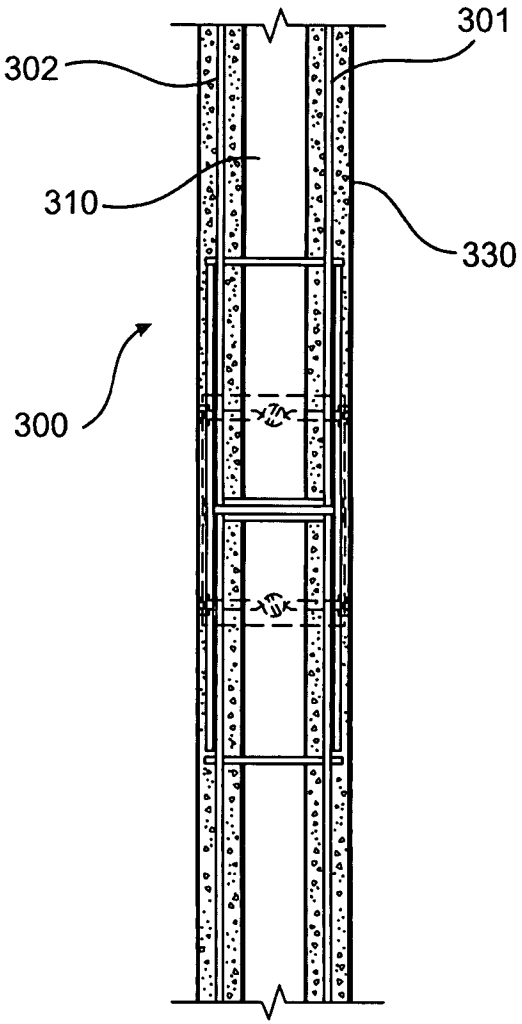
FIGS. 9A and 9B are cross-sectional side views of two different width finished SCIP panel members according to the invention.
Figure 9A:
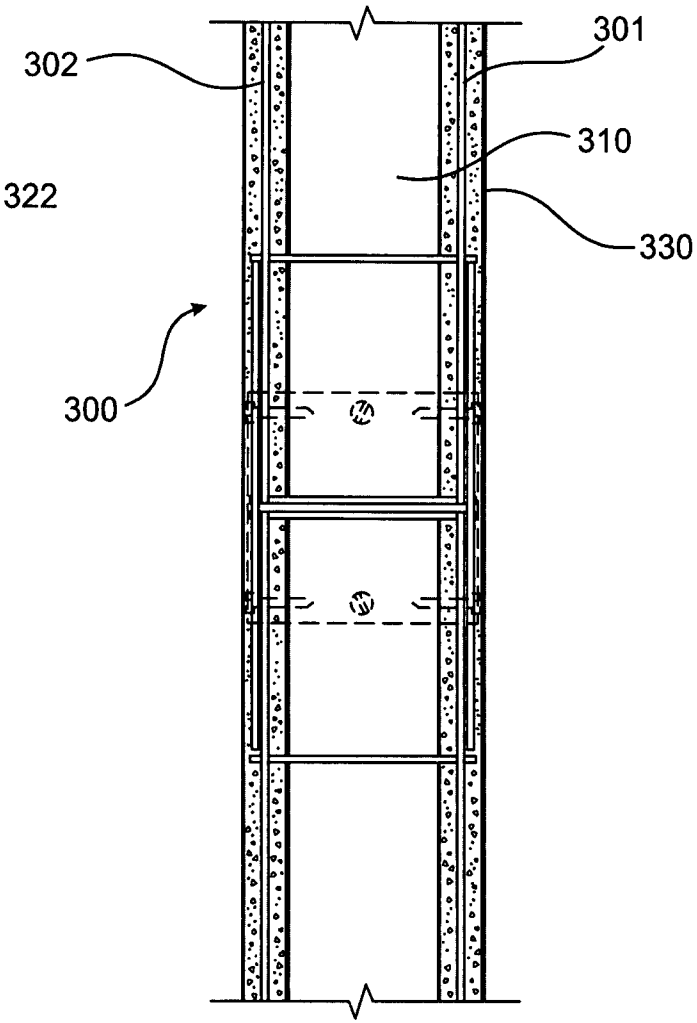

Middle member 310 may comprise any suitable material for the construction project undertaken. In a presently preferred embodiment of a support wall, the middle member 310 comprises readily available 2"×6", 4"×6", or 6"×6" polystyrene blocks. FIG. 9A depicts a cross sectional view of a six inch (actually 6⅜") wall connection using 4"×6" blocks of polystyrene foam insulation. FIG. 9B depicts a cross sectional view of a 4 inch wall connection using 2" polystyrene foam insulation.

Figure 8:
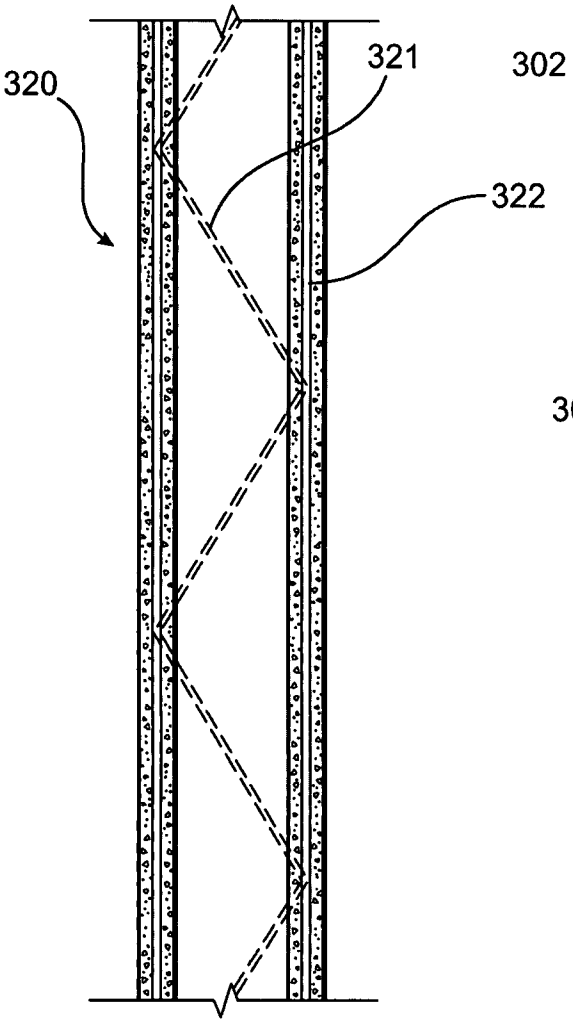
FIG. 8 is a side view of a preferred embodiment of a SCIP finished panel member according to the invention.

Wire trusses 320 may be of any suitable configuration and secured by any suitable means. In a presently preferred embodiment, the trusses comprises 3-inch, 5-inch or 7-inch welded galvanized truss attached using 11 gauge galvanized hog rings disposed every foot to 1"×1" 14 gauge mill galvanized welded end wires of wire mesh members 301, 302 having built-in depth screeds. As depicted in FIG. 8, presently preferred is a steel truss fabrication comprising a 3/16" gauge truss web 321 factory welded to a 3/16" wire cord 322 which is factory welded to each strut and grid. The truss may utilize a typical truss gauge of 73/16".

Figure 10:
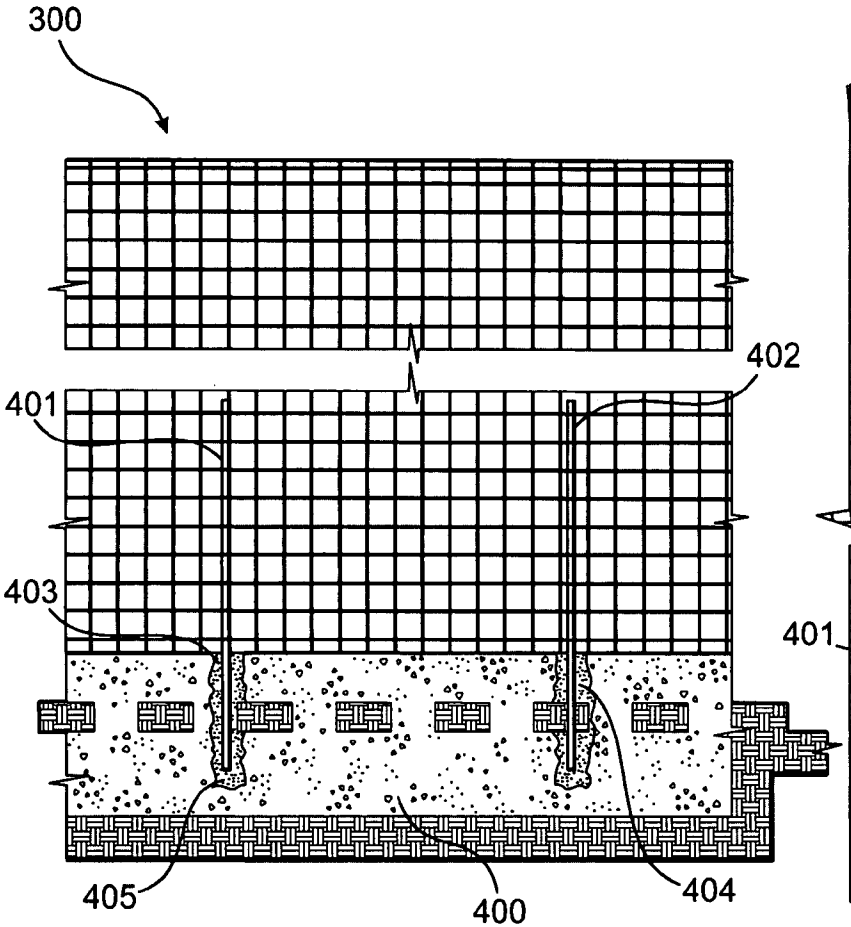
FIG. 10 is a partial cross-sectional view of a SCIP panel member erected on a foundation or slab for use in a wall or corner assembly according to an embodiment of the invention.

FIG. 10 is a depiction of a SCIP panel 300 erected as a support wall. According to a preferred method of installing a 4-inch SCIP panel, two parallel chalk lines (not shown) spaced 4¼ inches apart are made on the foundation or slab 400 where the SCIP panel is to be erected. These chalk lines are used to align 24" re-bar dowels 401, 402 every two feet. Preferably, the dowels 401, 402 are positioned such that the SCIP panel 300 will align with the first dowel 401 one-foot to the left of the centerline of the SCIP panel and align with the second dowel 402 one-foot to the right of the centerline of the SCIP panel.

Dowels 410, 402 are used to anchor SCIP panel 300 to the foundation or slab 400. A pair of 6¾ inch deep holes 403, 404 are drilled into the foundation or slab 400 for receiving dowels 401, 402. Dowels 401, 402 are preferably anchored into the concrete with grout or epoxy 405. Notably, although not shown, there is preferably a matching pair of dowels, or corresponding dowels, disposed and anchored on the other side of the panel 300. The four dowels preferably ascend about 18 inches vertically from the slab 400.

The SCIP panel 300 is positioned vertically so that the dowels can slide into the ½ inch space (not shown) between the backside of the wire mesh member and the leading edge of the expanded polystyrene foam insulation. Preferably, about ½ inch of the foam is melted or removed from the back side of each dowel so that 1½ inch of shotcrete, plaster, or other suitable material can encapsulate each dowel. The dowels are then connected to the wire mesh 301 using wire ties (not shown), preferably two ties per dowel. However, any suitable securing means may be used. Once secured, the panel may be finished according to the methods previously discussed.

Figure 11:
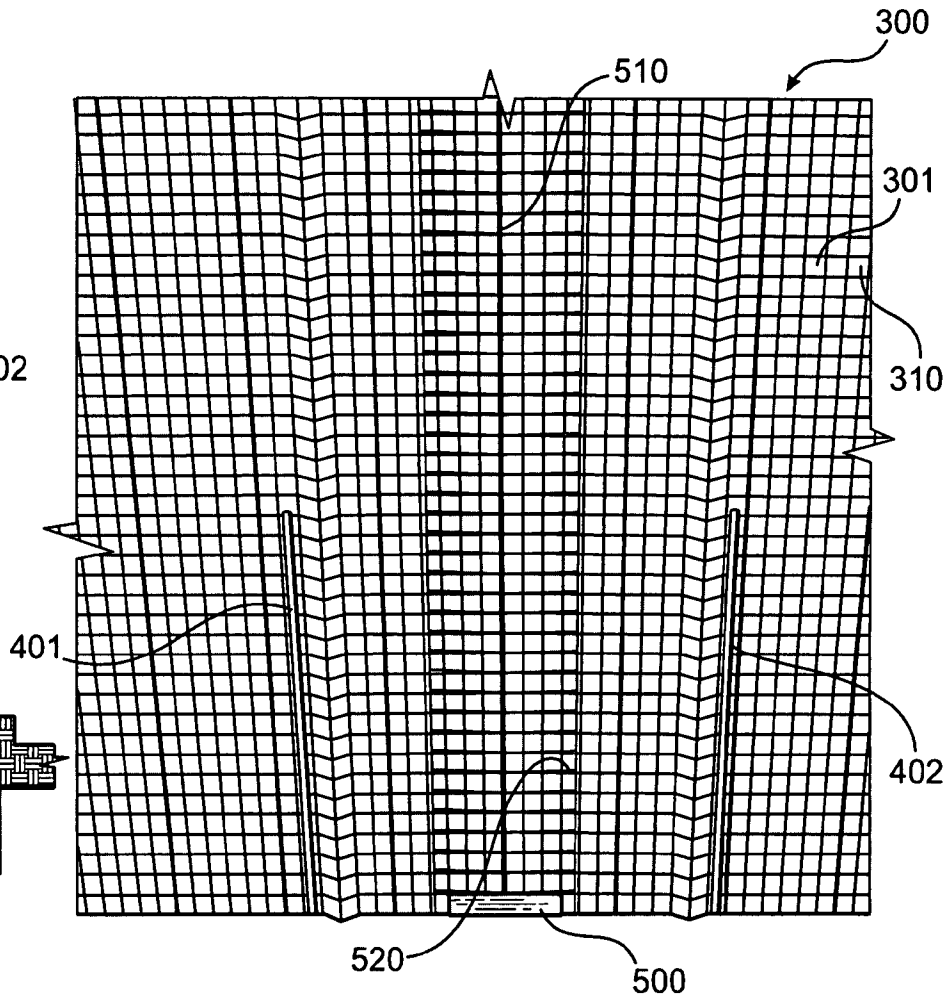
FIG. 11 is a photograph of the bottom of two SCIP panel members joined for use in a wall or corner assembly according to the invention.
Figure 12:
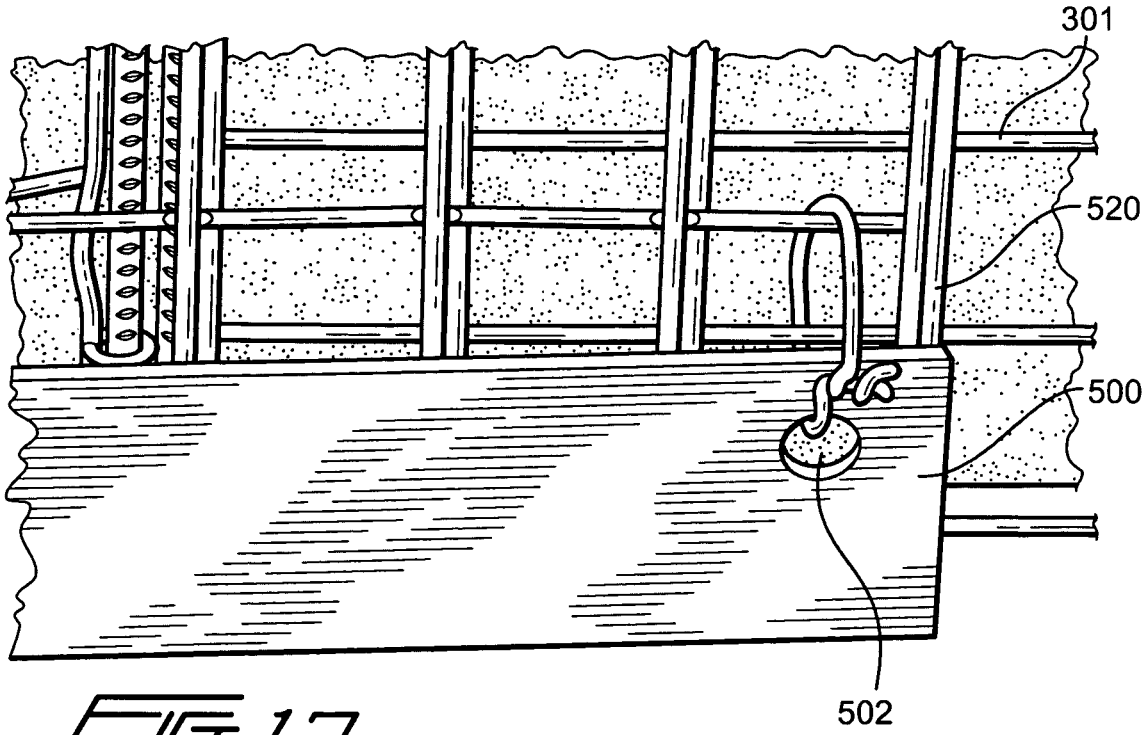
FIG. 12 is a close-up photograph of the metal clip depicted in FIG. 11 for joining two panel members according to the invention.

The lateral mating of two SCIP panels is depicted in FIGS. 11 and 12. Although any suitable means for securing SCIP panels at the seams may be used, in a presently preferred embodiment, if two or more SCIP panels are going to be connected laterally, the present inventors have developed a novel metal clip to use for this purpose. As shown in FIG. 11, after the chalk lines are laid, in addition to providing dowels 401, 402 every 24 inches, a metal clip 500 is secured to the slab 400 using a pair of ¼" diameter screws (not shown) wherever two SCIP panels 300 will meet to form a seam 510.

As best discerned from FIG. 12, the presently preferred clip 500, which is commercially referred to as the "MetRock-SCIP Metal Clip," is a 6" long and 5 3/16" wide 22 gauge galvanized metal clip with a 1½ inch metal flange 501 on each side of the clip 500. Obviously, the width of the clip will vary based on the size of wire trusses used to manufacture the panel 300. For example, the metal clip for a 3" truss will have an inside diameter of 3 3/16." Holes 502, preferably ⅜" in diameter, are drilled on each end of the clip on preferably, both the front 503 and back of the clip 500.

When two panels are two be erected and joined at a seam 510, it is presently preferred that a 12-inch lap of mesh be disposed on each panel at the seam using hog rings (not shown). Alternatively, as depicted in FIG. 11 a 6-inch lap 520 may be used, although a 12-inch lap is presently preferred.

As shown in FIG. 12, once the SCIP panels are positioned over the dowels and into the clip, wire tie 505 is inserted through the left front hole 502 of clip 500 for securing the wire mesh 301 of the right SCIP panel and the lap 520 of the left SCIP panel to the clip 500. Likewise, although not shown, the other three holes in the clip are disposed to allow a wire tie to secure a portion of the wire mesh of a SCIP panel and a portion of the lap of the adjacent SCIP panel to the clip.

The invention also includes novel methods and tools for securing construction panels in alignment until for finishing with, for example, shotcrete or plaster. These novel methods and tools are particularly useful when assembling SCIP panels in a corner or perpendicular configuration. FIGS. 13-15 depict four SCIP panels 601, 602, 603, and 604. Panels 601 and 602 and panels 603 and 604 have been laterally mated according to the methods described above including the use of metal clip 500. At this juncture, panels 602 and 603 form a corner 620 which must be kept square for the application and hardening of a shotcrete, or other cementitious material, application on the outside of the panels.

Figure 14A:
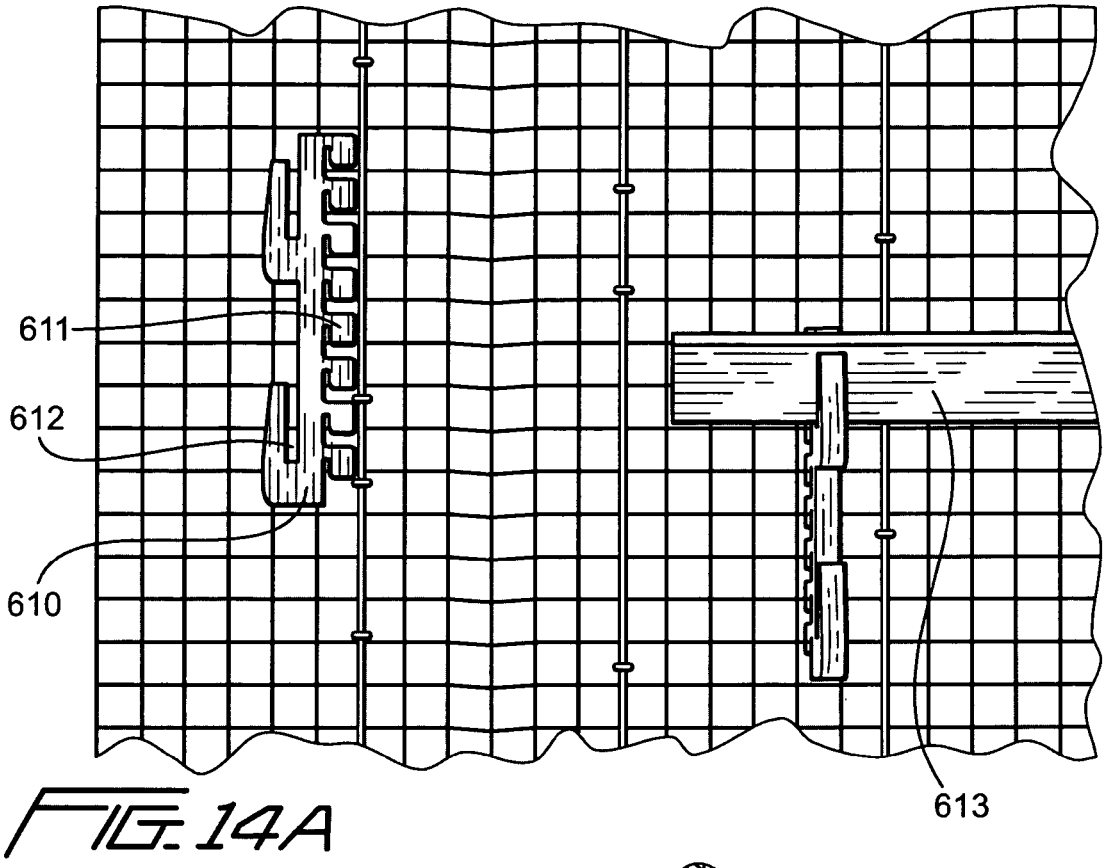
FIGS. 14A and 14B are photographs of a plastic clip for use in the plastic clip-angle iron assembly for aligning panels according to the invention.
Figure 14B:
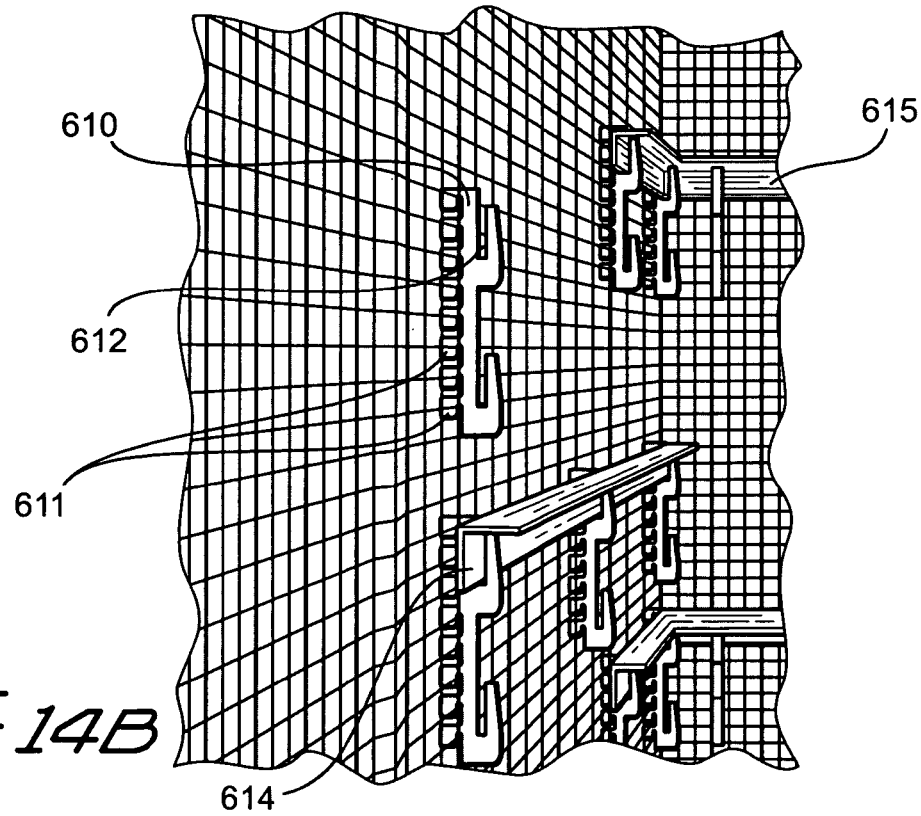
Figure 15B:
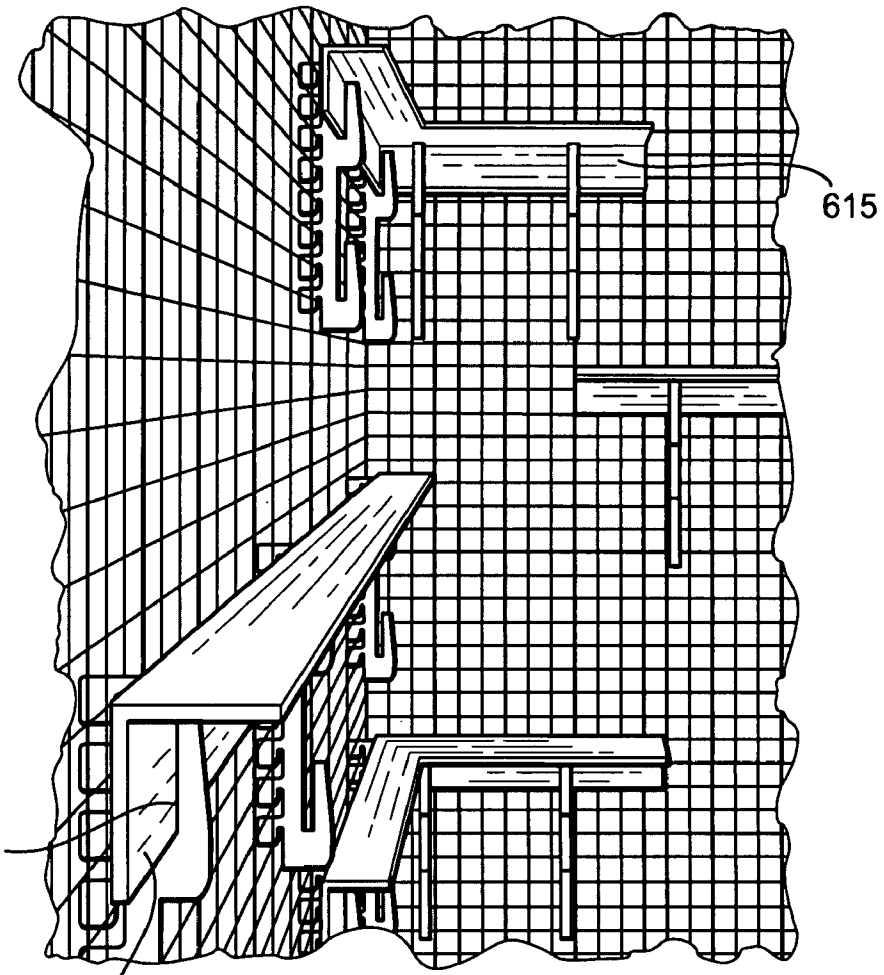
FIGS. 15A and 15B are photographs of a corner assembly using the plastic clip-iron angle assembly according to the invention.
Figure 15A:
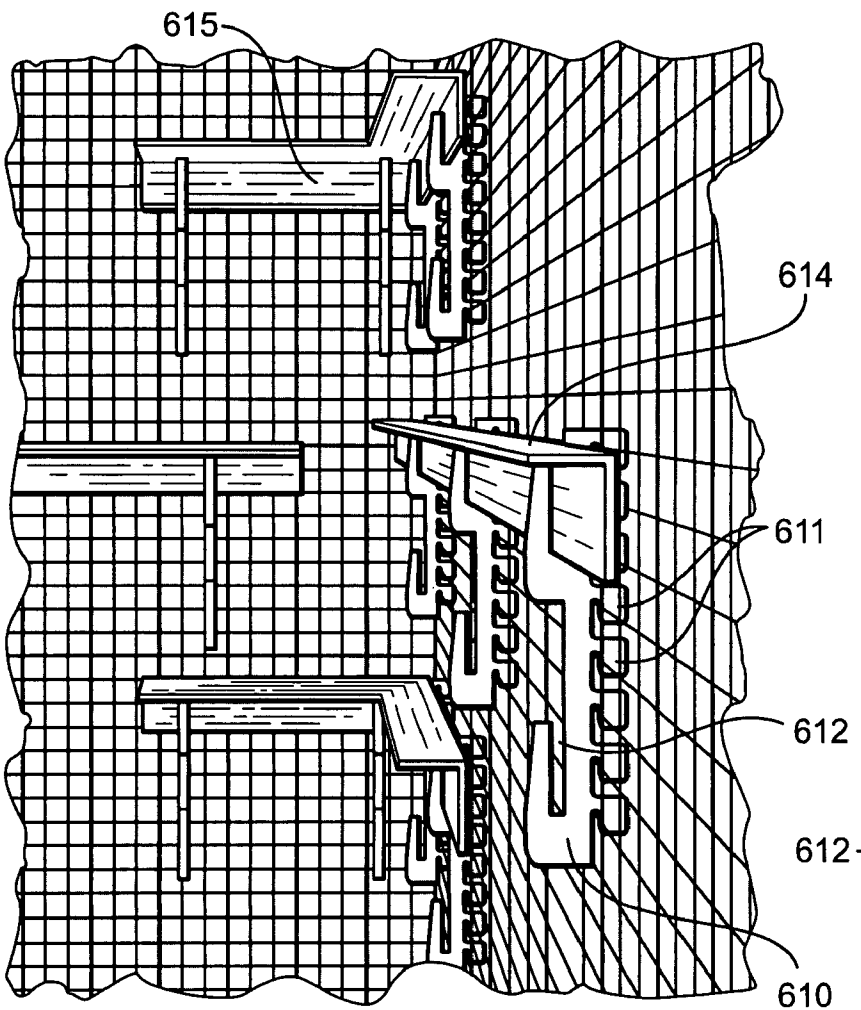

As best shown in FIGS. 14A and 14B, temporary clips 610, preferably made of plastic, have a plurality of hooking members 611 on one side and at least one slot 612 on the other side are snapped into wire mesh 301. The hooking members 611 are spaced apart and configured to be removably couplable to the wire mesh. The slot(s) 612 is configured to receive at least on rigid member 613. Preferably, rigid member 613 comprises an angle iron. In operation, the plastic clips 610, which are referred to commercially as "Temporary MetRockSCIP Plastic clips," are horizontally aligned and snapped into the wire mesh approximately every 36" off-center. Preferably, the clips 610 are attached approximately every 45" off-center horizontally. In the presently preferred embodiment, the clips 610 are designed to receive at least one piece of a 2"×2"×¼" angled metal 613. For holding lateral panels 601 to 602 and 603 to 604, angled metal is a straight piece of angled metal 614. However, the clips are positioned on panels 602 and 603 near the corner for receiving an "L"-shaped piece, or elbow, of angled metal 615. As will be appreciated, when the metal members 614 and 615 are inserted into the slots 612 of the clips 610 (and in conjunction with metal clips 500 at the seams) the panels 601, 602, 603, and 604 are held in the proper position for the outside to be finished with shotcrete. This configuration serves to hold the panels in alignment and the corners square. Once the shotcrete, or other cementitious material has dried, the angled metal and clips are removed and the inside can be finished with shotcrete or other cementitious material.

Figure 18:
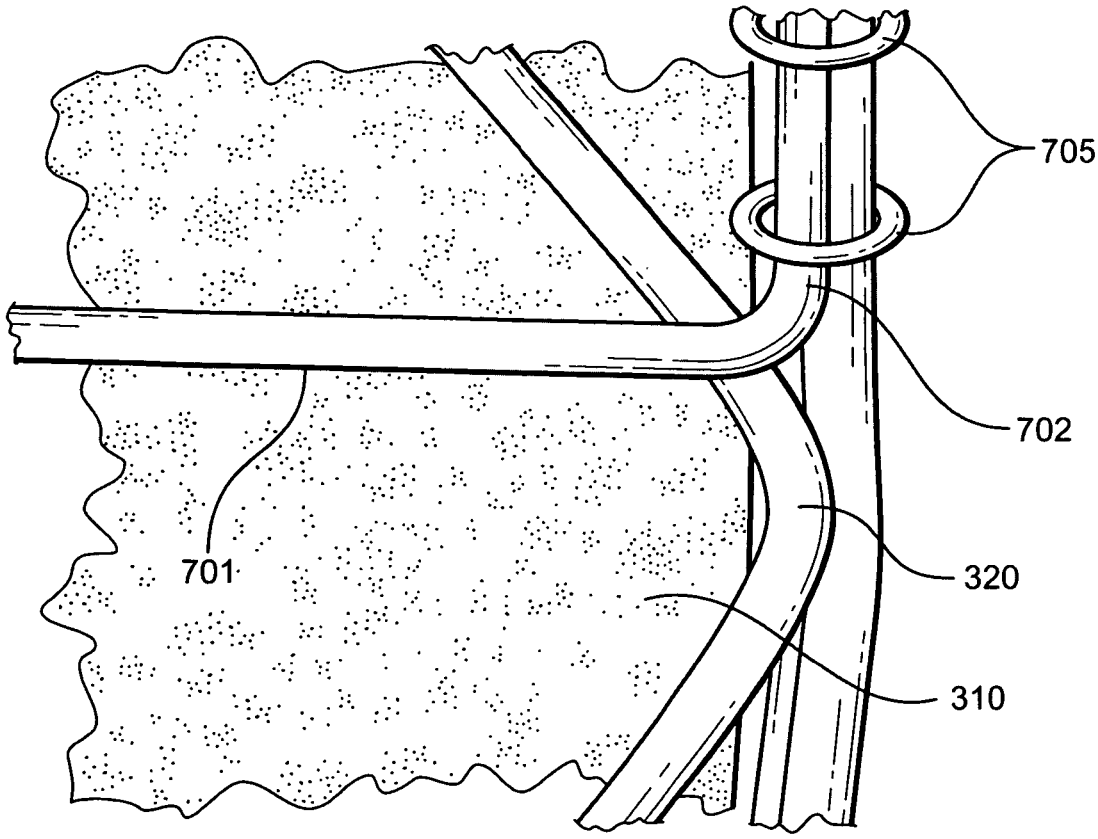
FIG. 18 is a close-up photograph of one end of a Z-clip inserted through two hog rings of a panel according to the invention.
Figure 16:
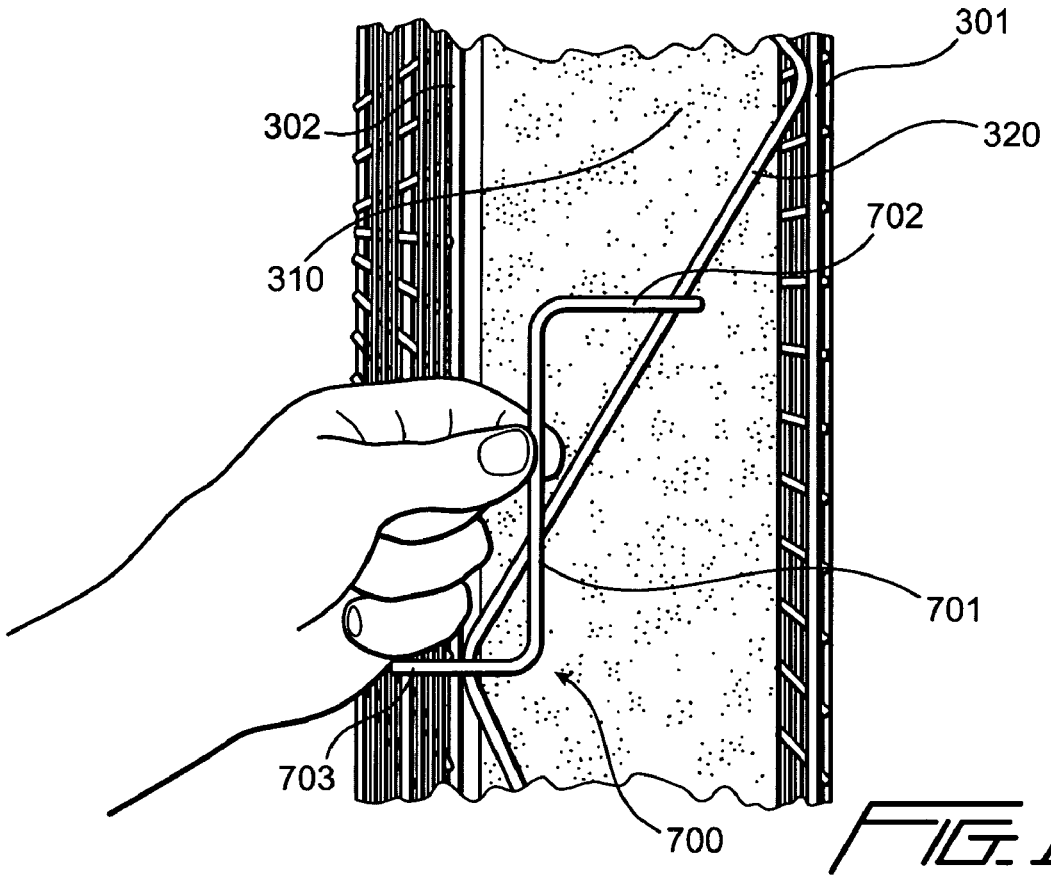
FIG. 16 is a close-up photograph of a Z-clip according to the invention.
Figure 17:
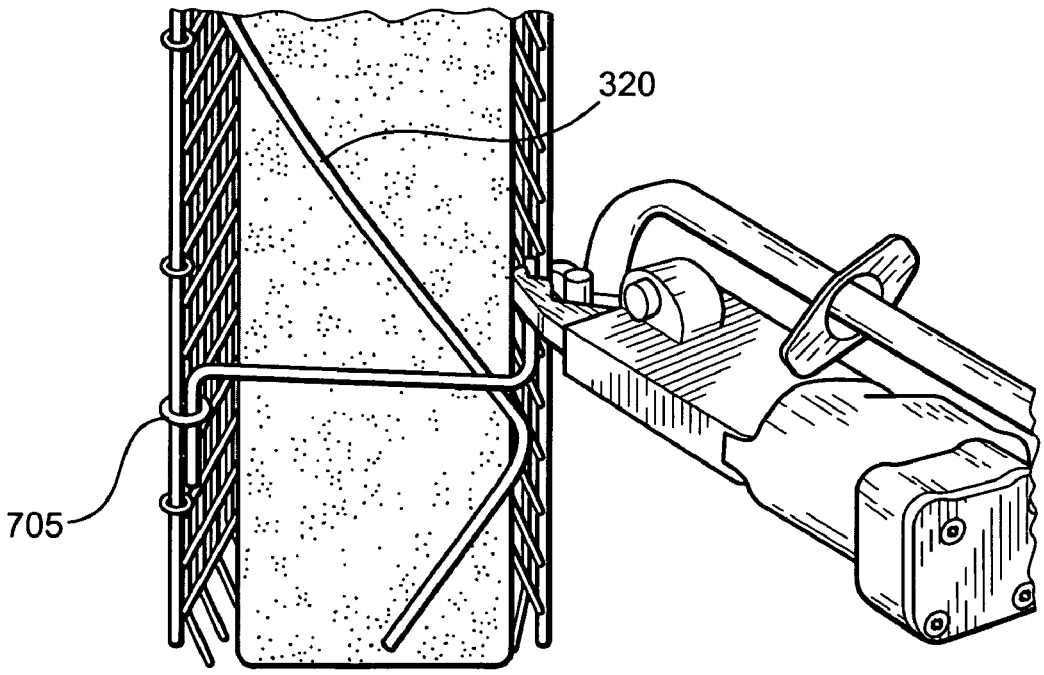
FIG. 17 is a photograph of a Z-clip attached to a panel according to the invention.

FIGS. 16-18 depict yet another tool and method for manufacturing SCIP construction panels. To further secure wire mesh members 301 and 302, a "Z-clip" 700 may be used. As best shown in FIG. 16, Z-clip 700 comprises a piece of metal, preferably 3⁄16" galvanized wire bent into a pseudo-Z shape configuration. The Z-clip has a body section 701 and a pair of parallel, but oppositely oriented arms 702, 703. The Z-clip 700 is sized to attach to each truss while manufacturing the Met-Rock Panel 300. As shown in FIG. 17, the Z-clip's oppositely oriented arms 702, 703 are inserted through hog rings 705 disposed on each truss. As shown in FIG. 18, it is presently preferred to have the oppositely oriented arms traverse two hog rings 705. The Z-clip is particularly recommended when the panels are used for roof and floor panels, as well as when used as a retaining wall or for cistern or pools and the like where ground or water pressure is a concern.

Figure 21:
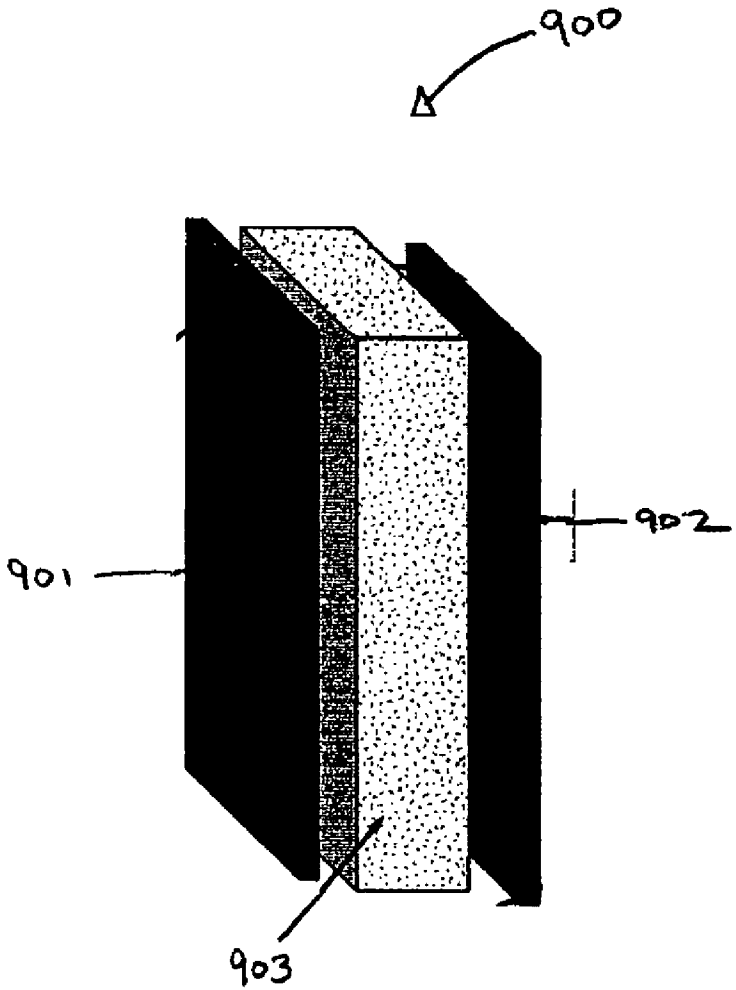
FIG. 21 is an expanded side view of a non-structural panel member according to the invention.

Turning to FIG. 21, a non-structural panel 900 for use with the present invention is depicted. As shown, the non-structural panel 900 includes exterior and interior sheathing 901, 902 that sandwich a foam core 903. In a preferred embodiment, the panel sheathing 901,902 utilizes fiber cement board, and in a particularly preferred embodiment, ¼" James Hardie® backer boards (Hardie board). The backer boards 901, 902 are glued, or otherwise attached to, the foam core 903.

In a presently preferred embodiment the foam core comprises a polyurethane materials, such as that commercially and readily available under the tradename Styrofoam®. As will be appreciated by one of ordinary skill in the art, the thickness of the foam core 903 can be varied for the desired thickness of the interior or non-load bearing wall or ceiling. Likewise, while the present embodiment depicts the use of Hardie boards and a foam core, one of ordinary skill in the art will readily appreciate that other materials that provide similar advantages may be used in connection with the invention. Such considerations for the choice of appropriate materials may include some of the following: energy-efficiency, recyclable materials, ease of construction, low cost, fire resistance, sound dampening, compatibility connections and/or finishing with the SCIP members, etc.

For example, in an alternative embodiment, where the non-structural panels are used for interior walls (where the foam insulation would serve only a purpose of deafening sound transmission), the invention contemplates the use of steel studs as the core between the two sheets of Hardie backer As will be appreciated, this configuration would be economically feasible and would also maintain out sustainability. Typically in any case, the thickness of the non-structural panel would be 3.75-4".

Again, as will be appreciated by one of ordinary skill in the art armed with the present specification, the use of these non-structural panels as described and claimed herein in the construction of a building will greatly reduce the cost of the building. Likewise, the non-structural panels still allow for non-skilled labor to quickly assemble and finish the panels on-site.

When used as interior walls, the non-structural panels 900 are preferably anchored to the wall and ceiling. There are several ways of positioning and anchoring the non-structural panels. According to one embodiment, a steel track (not shown) can be applied to the floor and ceiling and the panel 900 slides over the track and is glued into place. Alternatively, the panel can simply be glued to the floor and ceiling.

With respect to the positioning and securing of the non-structural panels with the SCIPs, in a presently preferred embodiment, the non-structural panels simply abut against a bare SCIP. Once in place, the SCIP receives its cementitious shell which is deposited and smoothed according to the methods described herein. The SCIP-non-structural panel assembly is then finished with the same finish coat. As will be appreciated, the finishing of the assembly with the same finish coat achieves the uniformity of appearance and texture desired.

Those skilled in the art will appreciate that various adaptations and modifications of the above-described preferred embodiments can be configured without departing from the scope and spirit of the invention. Therefore, it is to be understood that, within the scope of the appended claims, the invention may be practiced other than as specifically described herein.

I claim:

1. A building assembly comprising:

an exterior or load bearing panel connected to a non-load bearing panel to form a building assembly substrate;

said exterior or load bearing panel comprising a pair of wire mesh members sandwiching a middle member comprising polystyrene, each of said wire mesh members defining two outwardly projecting screed ridges extending a length of said wire mesh members, wherein each of said screed ridges are configured as V-shaped impressions having an apex extending about ½ inch and oriented such that the apexes of each wire mesh member extend away from said middle member;

said non-load bearing panel comprising a pair of fiber cement boards sandwiching a core member;

an outer layer of cementitious material applied to each of said wire mesh members of said exterior or load bearing panel of said building assembly substrate to a depth extending from said middle member to the apexes of said inner and outer mesh members; and a final finish layer applied to said building assembly substrate after the application of said cementitious layer.

2. The building assembly of claim 1, wherein said non-load bearing panel is about 3.75 to 4 inches thick.

3. The building assembly of claim 2, wherein said non-load bearing panel's core comprises polystyrene.

4. The building assembly of claim 3, wherein said non-load bearing panel's polystyrene core comprises expanded polystyrene foam.

5. The building assembly of claim 1, wherein said non-load bearing panel's core member comprises steel studs.

6. The building assembly of claim 1, wherein said exterior or load bearing panel's screed ridges extend the entire length of said wire mesh members from a top end to a bottom end.

7. The building assembly of claim 6, wherein said exterior or load bearing panel's wire mesh members are approximately 47.25 inches to 48 inches wide and include two parallel screed ridges positioned approximately 30 inches off center.

8. The building assembly of claim 6, wherein said exterior or load bearing panel's wire mesh members are approximately 47.25 inches to 48 inches wide and include three parallel screed ridges such that a first screed ridge is positioned at about 24 inches from each side edge of said mesh member, a left ridge at about 8 inches from the left edge of said mesh member, and a right ridge about 8 inches from a right edge of said mesh member.

9. The building assembly of claim 6, wherein said middle member comprises a plurality of layers comprising wire trusses and polystyrene and is disposed between said wire mesh members to define a gap between said middle member and each of said wire mesh members.

10. The construction panel of claim 9, wherein said middle member is connected to each wire mesh member by attaching said mesh members to trusses on outside ends of said middle member.

11. A building assembly comprising:

an exterior or load bearing panel connected to a non-load bearing panel to form a building assembly substrate;

said exterior or load bearing panel comprising a pair of wire mesh members sandwiching and spaced from a middle member comprising polystyrene, each of said wire mesh members defining a grid of vertical and horizontal wire strands including a planar section and a section defining at least one outwardly projecting screed ridge extending an entire length of said wire mesh member, the screed ridge being configured as a V-shaped impression and having an apex extending away from said middle member;

said non-load bearing panel comprising a pair of fiber cement boards sandwiching a core member;

an outer layer of cementitious material applied to each of said wire mesh members of said exterior or load bearing panel of said building assembly substrate to a depth extending from said middle member to the apexes of said inner and outer mesh members; and a final finish layer applied to said building assembly substrate after the application of said cementitious layer.

* * * * *